US005085967A

United States Patent [19]

Usui et al.

[11] Patent Number: 5,085,967

[45] Date of Patent: Feb. 4, 1992

[54] WET-TYPE ELECTROSTATIC PHOTOGRAPHIC TRANSFERRING METHOD

[75] Inventors: Tetuo Usui; Nobuo Suzuki; Yutaka Sakasai; Hisao Oh-Ishi, all of Kanagawa, Japan

[73] Assignee: Fuji Photo Film Co., Ltd., Kanagawa, Japan

[21] Appl. No.: 495,956

[22] Filed: Mar. 20, 1990

[30] Foreign Application Priority Data

Mar. 22, 1989 [JP] Japan ..... 1-70158

[51] Int. Cl.[5] ..... G03G 13/16; G03G 13/10

[52] U.S. Cl. ..... 430/126; 430/117

[58] Field of Search ..... 430/114, 126, 117

[56] References Cited

U.S. PATENT DOCUMENTS

| | | | |
|---|---|---|---|
| 3,120,446 | 2/1964 | Hunter | 430/126 |
| 3,647,499 | 3/1972 | Colt et al. | 430/120 |
| 4,818,657 | 4/1989 | Kondo et al. | 430/114 |

*Primary Examiner*—John Goodrow

*Attorney, Agent, or Firm*—Sughrue, Mion, Zinn, Macpeak & Seas

[57] ABSTRACT

Wet-type electrostatic photographic transferring method is disclosed, comprising developing an electrostatic latent image formed on an image-carrying member with an electrostatic photographic liquid developer containing at least toner particles and a carrier liquid, and transferring the toner image from the toner image-carrying member to a member to which the image is to be transferred, by one transferring step or a plurality of transferring steps, characterized in that the transferring step includes at least the following steps: (1) a step to substantially dry the toner image; (2) a step to supply a non-aqueous solvent having a volume resistance of at least $10^9$ Ω·cm and a dielectric constant of not more than 3 into a clearance between the toner image-carrying member and the member to which the image is to be transferred; and (3) a step to transfer the toner image to the member to which the image is to be transferred.

11 Claims, 1 Drawing Sheet

WET-TYPE ELECTROSTATIC PHOTOGRAPHIC TRANSFERRING METHOD

FIELD OF THE INVENTION

The present invention relates to a wet-type transferring method using a liquid developer and more particularly to a wet-type transferring method capable of providing a transferred image excellent in quality.

BACKGROUND OF THE INVENTION

Heretofore, as a method of transferring an image, comprising developing an electrostatic latent image on a light-sensitive member with a liquid developer and transferring the above developed image to a member with which the image is to be transferred, such as a transferring paper, the following have been known. One of the methods is a method in which an electrostatic latent image on an image-carrying member is developed with a liquid developer, and then the developed image is superposed on a member to which the image is to be transferred, while a sufficient amount of a carrier liquid remains, and is transferred to the member by corona transferring or bias roller transferring. In this method, however, the carrier liquid present between the member to which the image is to be transferred and the image-carrying member sometimes flows, thereby producing a flow in transferred image. Another method is the method wherein transferring is carried out by bringing a toner image-carrying member in direct contact with a member to which the image is to be transferred, by the use of a roller. In this method, however, the carrier liquid on the image-carrying member sometimes flows at the time of contacting, thereby disturbing the image on the image-carrying member or causing a flow in transferred image.

In order to overcome the above problems, JP-B-46-1799 (the term "JP-B" as used herein means an "examined Japanese patent publication") discloses a method in which two transferring rollers are provided, and a reverse bias relative to that applied to the second roller is applied to the first roller. In accordance with this method, a disturbance in transferred image can be prevented to a certain extent bu not sufficiently. JP-B-51-44654 discloses a method in which, after development, the thickness of a carrier liquid on an image-carrying member is controlled to 5 to 30 μm by corona discharging and, thereafter, transferring is conducted. This method overcomes the problems of the above method by placing a necessary and sufficient amount for wet-type transferring of a carrier liquid between an image-carrying member and a member to which the image is to be transferred, and increases a transferring efficiency and decreases unnecessary permeation of the liquid into the member to which the image is to be transferred.

In accordance with this method, the flow in transferred image due to excessive carrier liquid present at the time of transferring may be prevented to a certain extent by controlling the liquid thickness. This method, however, has a disadvantage that the image on the image-carrying member is disturbed by corona discharging to be applied for controlling of liquid thickness. JP-B-62-49619 discloses a method in which a resin solution is placed between an image-carrying member and transferring sheet to thereby uniformly control the attached amount in transferring. In this method, however, prevention of flow in image at the time of transferring is not sufficiently improved. Moreover, this method has problems in that when a member to which an image is to be transferred, which has been obtained by the method, is used as printing plate, dissolved resin is liable to attach to the printing plate, thereby causing contamination of the background.

SUMMARY OF THE INVENTION

An object of the present invention is to provide a transferring method capable of providing a high quality toner transferred image which is free from problems such as a flow in image produced when a toner image formed with a liquid developer for electrostatic photography is transferred to a member to which the image is to be transferred.

Another object of the present invention is to provide a transferring method excellent in a toner image transferring efficiency.

As a result of investigations, it has been found that the objects can be attained by employing a wet-type electrostatic photographic transferring method comprising developing an electrostatic latent image formed on an image-carrying member with an electrostatic photographic liquid developer containing at least toner particles and a carrier liquid, and transferring the toner image from the toner image-carrying member to a member to which the image is to be transferred, by one transferring step of a plurality of transferring steps, characterized in that the transferring step includes at least the following steps:

(1) a step to substantially dry the tone image;

(2) a step to supply non-aqueous solvent having a volume resistance of at least $10^9$ Ω·cm and a dielectric constant of not more than 3 into a clearance between the toner image-carrying member and the member to which the image is to be transferred; and (3) a step to transfer the tone image to the member to which the image is to be transferred.

BRIEF DESCRIPTION OF THE FIGURES

FIGS. 1 and 2 are micrographs of lines with a width of 70 microns in the transferred images obtained in Example 11, wherein FIG. 1 is an enlarged photograph (x78) of Comparative Example A and FIG. 2 is an enlarged photograph (x78) of Present Invention B.

DETAILED DESCRIPTION OF THE INVENTION

Figure 1:
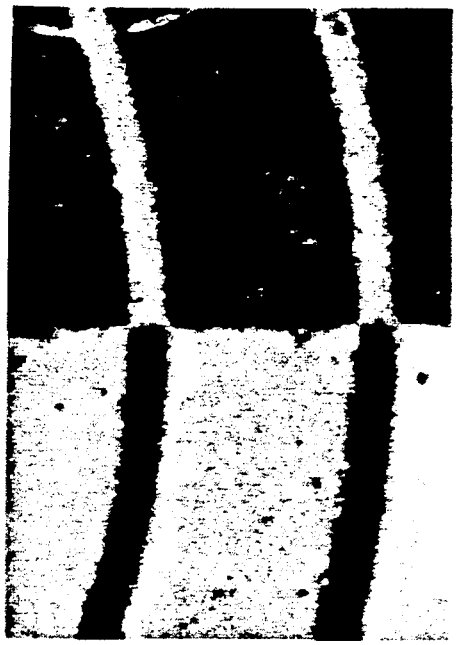
Figure 2:
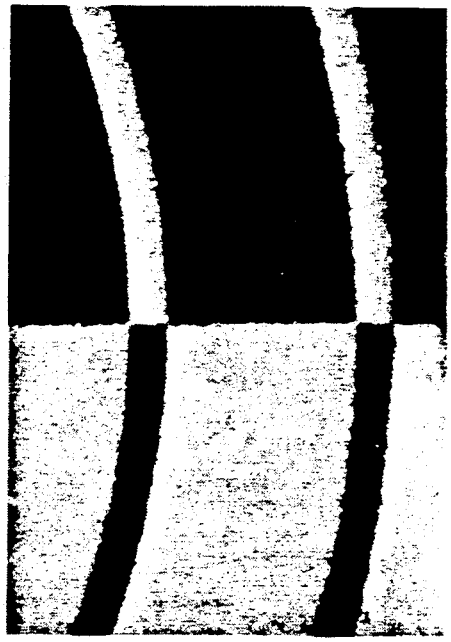

Although the mechanism of action of the present invention is not clear, it is considered that when a carrier liquid is evaporated after formation of a toner image, toner particles combine together or agglomerate and thus they do not separately move at the time of transferring; that is, toner particles are transferred in the form of an agglomerate.

The conventional transferring method sometimes includes a step of removing a part of the carrier liquid. It is considered that toner particles are singly transferred because they are not substantially dried, and the image quality is reduced by a disturbance at the time of transferring.

The present inventors disclose in JP-A-1-225975 that the quality of the transferred image is increased by adjusting the amount of the carrier liquid after toner development to 2 to 20 mg per of the tone (the term "JP-A-" as used herein means an "unexamined published Japanese patent application"). In accordance with this method, however, the weight of the carrier liquid is difficult to control and the quality of the transferred image cannot be said to be sufficiently high.

It is considered that in the method of the present invention, the mutual action among toner particles is increased by substantially drying the tone image, whereby the quality of the transferred image can be increased. Moreover, by filling a suitable amount of non-aqueous solvent in the clearance between the image-carrying member and the member to which the image is to be transferred after evaporation of the carrier liquid, controlling can be easily performed.

In connection with a step of forming a toner image on an image-carrying member, the tone image can be formed by forming an electrostatic latent image by a conventional method such as an electrostatic photographic method and an electrophotographic method and, thereafter, developing the latent image with a liquid developer for electrostatic photography.

For the purpose of removing soluble components, such as ion components and a dispersing agent, in a liquid developer, or an excess of toner particles and so on after formation of toner image, if desired, rinsing with a non-aqueous solvent of at least $10^9$ Ω·cm (hereafter sometimes referred to as the rinsing solution) can be applied. This rinsing permits removal of soluble components, such as ion components and a dispersing agent, in a liquid developer and so on.

Then, a carrier solvent of a liquid developer or a rinsing solution on a image-carrying member is substantially dried. This drying method is not critical; various methods such as a natural drying method in which the member is allowed to stand for a predetermined time, a method in which cold air or hot air is blown, a method utilizing radiation energy such as infrared rays, rollers, corona discharging, blading and so on can be employed, or two or more of these may be employed in combination.

"The step of substantially drying" as used herein means a step in which a carrier liquid or a rinsing solution is evaporated or condensed in order to increase the action among toner particles and to prevent deterioration of toner image quality at the time of transferring. The degree of drying varies with the constitution of the liquid developer and cannot be specified unconditionally. For example, when a part of toner particles are dissolved or swelled in the carrier liquid or the rinsing solution, even if the amount of remainder is large, the mutual action among particles is large. When a part of toner particles are not swelled in the carrier liquid or the rinsing solution, the mutual action can be realized by decreasing the amount of the remainder. That is, a toner image which has been subjected to "substantial drying" is in the state that the carrier liquid or the rinsing solution is evaporated to such an extent that almost no liquid is observed on the surface. More specifically, the carrier liquid or the rinsing solution is dried and condensed preferably to not more than 20 mg per milligram of the toner particle and more preferably to not more than 10 mg per milligram of the toner particle. It is particularly preferred that the amount of the remaining carrier liquid or rinsing solution is controlled to not more than 5 mg.

Then, a toner image on the image-carrying member is transferred to a member to which the image is to be transferred. In this transferring, a non-aqueous solvent for transferring is previously supplied to the surface of the image-carrying member, the surface of the member to which the image is to be transferred, or the surfaces of both.

The amount of the non-aqueous solvent supplied varies with the type of the member to which the image is to be transferred, and cannot be determined unconditionally. For example, when the member to which the image is to be transferred does not absorb the non-aqueous solvent like an aluminum substrate, a polyethylene terephthalate film and the like, the amount of the non-aqueous solvent supplied is preferably 2 to 80 g/m$^2$ and more preferably 2 to 40 g/m$^2$.

When paper is used as the member to which the image is to be transferred, the amount of the non-aqueous solvent supplied varies with ordinary paper, coat paper, art paper or paper subjected to water-repellent treatment, or its thickness, and is difficult to specify. In the case of ordinary paper (Copy Ace A, transferring paper for PPC), the amount of the non-aqueous solvent supplied is preferably 2 to 80 g/m$^2$ and more preferably 20 to 80 g/m$^2$.

If the amount of the non-aqueous solvent supplied is more than the above upper limit, an image flow or disturbance in image is produced. On the other hand, if it is less than the above lower limit, transfer unevenness or a decrease in transfer efficiency is sometimes produced.

As the carrier liquid and the rinsing solution, a non-polar non-aqueous solvent having an electric resistance of at least $1\times10^9$ Ω·cm and a dielectric constant of not more than 3 can be employed.

For example, solvents such as straight or branched aliphatic hydrocarbons, alicyclic hydrocarbons, aromatic hydrocarbons and halogenated hydrocarbons can be used. From viewpoints of volatility, safety, pollution, odor and so on, octane, isooctane, decane, isodecane, dodecane, isododecane, nonane, and isoparaffin-based petroleum solvents such as Isopar E, Isopar G, Isopar H, Isopar L (Isopar is a trade name of Exxon Corp.), Solvesso 100 and Shell Zol 71 (produced by Shell Co.) are suitable.

Thereafter, the surface of the image-carrying member and the surface of the member to which the image is to be transferred are superposed or brought into contact to transfer the image. The transferring method is not critical and, for example, corona transferring and bias roller transferring for the electrostatic transferring method, and a transferring method to directly apply a voltage when the member to which the image is to be transferred is electrically conductive can be employed. The transferred image is dried and then fixed by a known method such as heating or evaporation of the solvent.

In addition to the aforementioned steps, in order to increase transferring efficiency, it is preferred to include a step in which after a toner image on an image-carrying member is substantially dried, corona discharging is applied to a toner image carrying member to uniformly charge the image on the image carrying member.

As the liquid developer to be used in the present invention, any desired known developers can be used. For example, the developers disclosed in JP-B-35-5511, JP-B-35-13424 and JP-B-50-40017 and JP-A-49-98634, JP-A-58-129438 and JP-A-61-180248, and *Denshishashin Gijutsu no Kiso to Oyo* ("Base and Application of Electrophotographic Art"), Denshishashin Gakkai, Corona Co., Ltd. (1988) can be used.

These liquid developers generally comprise a carrier liquid, a colorant to form a toner particle, a polymer resin coated with a colorant or providing adsorption properties to the colorant, a dispersing agent to accelerate dispersion of toner particles and to stabilize the resulting dispersion, and an electric charge controlling agent to control polarity and charging amount of toner particle. When coloring properties are not required of the toner, a toner not containing the colorant can be used.

As the resin, various known resins can be used. In particular, ethylene-based copolymers such as a copolymer of ethylene and (meth)acrylic acid, a copolymer of ethylene and vinyl acetate, a copolymer of ethylene and ethyl acrylate, a copolymer of ethylene and (meth)acrylic acid ester, and a terpolymer of ethylene, (meth)acrylic acid and (meth)acrylic acid ester are preferably used.

The concentration of toner particles in the developer is not critical, and is usually 0.1 to 10 g per liter of the developer.

As the electric charge controlling agent, various known ones can be used. The concentration of the electric charge controlling agent is 0.01 to 10 g, preferably 0.01 to 1 g per liter of the developer. As the dispersing agent, various known ones can be used. The concentration of the dispersing agent is 0.01 to 50 g, preferably 0.1 to 10 g per liter of the developer.

As the image-carrying member to be used in the present invention, known organic photoconductive materials or inorganic photoconductive materials as described in *Electrophotography*, R. M. Schafferrt, Focal Press (1980), *Denshishashin Gijutsu no Kiso to Oyo* ("Base and Application of Electrophotographic Arts"), edited by Denshishashin Gakkai, Corona Co., Ltd. (1988), etc. can be used. Dielectric members charged with a charging needle can be used.

The member to which an image is to be transferred, which is to be used in the present invention, is not critical and various ones can be used. For example, ordinary paper, various surface-coated papers, ZnO coated paper, an aluminum substrate for a printing plate, plastic films such as polyethylene terephthalate, polyethylene and triacetyl cellulose, and films with a metal layer vapor deposited thereon or coated with various polymers can be used.

As the aluminum substrate for printing, all aluminum substrates generally used in a presentized plate (PS plate) can be used. An aluminum substrate subjected to graining treatment or anodization treatment is preferably used.

The present invention is described in greater detail with reference to the following examples.

EXAMPLE 1

10 g of polycarbonate (trade name: Lexane 121, produced by G. E. Corp.), 6 g of a diarylamine compound shown below, and 60 mg of a styryl dye shown below as a sensitizing agent were dissolved in 80 ml of methylene chloride.

This solution was coated on a 100 micron thick polyethylene terephthalate film with a palladium vapor deposited layer, by the use of a wire bar, and then dried to remove the solvent. Thus an electrophotographic photoreceptor with a photoconductive layer having a thickness of 6 micron was obtained.

(Diarylamine Compound)

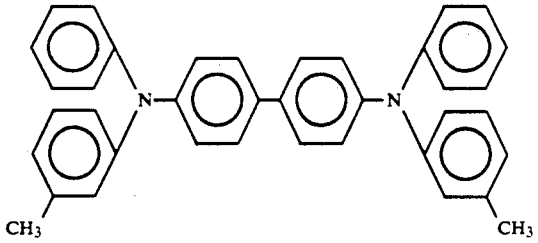

(Styryl Dye)

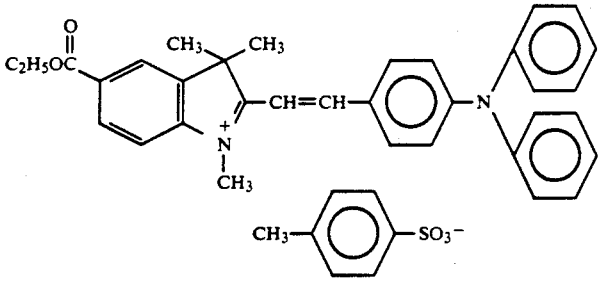

Separately, a liquid developer was prepared as follows.

Components having the formulation shown below were mixed in a kneader, and kneaded at 95° C. for 2 hours to obtain a kneaded material. This kneaded material was cooled in the kneader and then ground therein. Then one part by weight of the ground material and 4 parts by weight of Isopar H were dispersed in a paint shaker for 6 hours to obtain a dispersion. This dispersion was diluted with Isopar G in such a manner that the toner solid content was one gram per liter. At the same time, basic barium petronate as an electric charge controlling agent to provide minus changeability was added in an amount of 0.1 g per liter to thereby prepare a liquid developer.

| (Kneading Formulation) | |
|---|---|
| Ethylene-methacrylic acid copolymer | 3 parts by weight |

-continued

| (Kneading Formulation) | |
|---|---|
| (Nucrel N-699 produced by Mitsui Dupont Co., Ltd.) | |
| Carbon black #30 (produced by Mitsubishi Kasei Corp.) | 1 part by weight |
| Isopar L (produced by Exxon Corp.) | 12 parts by weight |

The surface of the electrophotographic photoreceptor which had been prepared above was charged to +400 V, and exposed to light through a positive original to form an electrostatic latent image. Just after development with the aforementioned liquid developer, the material was rinsed with Isopar H (produced by Exxon Corp.), the non-polar aliphatic hydrocarbon used in the carrier liquid, and then dried by allowing to stand at room temperature (25° C.-55RH%) for 14 minutes. The amount of the remaining carrier liquid was 1 mg per milligram of the toner.

On the aluminum substrate used in PS plate FPD-III (produced by Fuji Film Co., Ltd.), the above developed image carrying member was superposed after adjusting the amount of Isopar H to 16 g/m$^2$, 6 g/m$^2$ or 1 g/m$^2$, and the image was transferred by applying minus corona discharging from the side of the electrophotographic photoreceptor.

As transferred image properties, flow in image, unevenness in transferring, and resolving properties were examined. The results are shown in Table 1. The symbols in the table have the following meanings.

O: No flow in image, and sharpness of edge is good.

Δ: No flow in image, and sharpness of edge is slightly bad.

x: Flow in image.

The transferring effect was calculated from the equation shown below, in which Dm indicates an image density on the light-sensitive material at a density of about 1.5 before transferring and Dr indicates an image density on the light-sensitive material after transferring.

$$\text{Transferring Efficiency} = \frac{Dm - Dr}{Dm} \times 100$$

TABLE 1

Transferring Properties of Example 1

| No. | Amount of Remaining Rinsing Solution after Drying (Drying Time) | Evaluation Items | Amount of Liquid on Aluminum Substrate 16 g/m$^2$ | 6 g/m$^2$ | 1 g/m$^2$ |
|---|---|---|---|---|---|
| Example 1 | 1 mg/mg Toner weight (14 min) | Transferred Image Properties | O | O | O |
| | | Transferring Efficiency | 100% | 100% | x* |

*Transfer unevenness is partially observed.

As can be seen from Table 1, transferred image properties and transferring efficiency are both excellent.

The member to which the image had been transferred was, after heat fixing at 130° C. for one minute, dipped for 40 seconds in a 1:8 mixture of PS developer DP-4 (produced by Fuji Photo Film Co., Ltd.) and water, and washed with water. Then, after gum coating, the member was set on an Oliver 52 printing machine (manufactured by Sakurai Seisakusho Co., Ltd.) and was subjected to printing test.

As a result, a printed matter having a high image quality was obtained.

COMPARATIVE EXAMPLES 1 AND 2

An image was transferred in the same manner as in Example 1 except that drying after rinsing was carried out for 4 minutes and one minute, and the non-aqueous solvent at the time of transferring was not used. When the drying was carried out for 4 minutes and one minute, the amount of the remaining rinsing solution was 20 mg/mg-toner weight and 32 mg/mg-toner weight. Then, image transferring properties and transferring efficiency were examined in the same manner as in Example 1. The results are shown in Table 2.

TABLE 2

| No. | Amount of Remaining Rinsing Solution after Drying (Drying Time) | Evaluation Items | Results |
|---|---|---|---|
| Comparative Example 1 | 20 mg/mg toner weight (4 min) | Transferred image properties | Δ |
| | | Transferring efficiency | 95% |
| Comparative Example 2 | 32 mg/mg toner weight (1 min) | Transferred image properties | x |
| | | Transferring efficiency | 60% |

Comparative Example 1 was somewhat bad in transferred image properties, and Comparative Example 2 was bad in transferred image properties and transferring efficiency.

EXAMPLE 2

An image was transferred in the same manner as in Example 1 except that the non-aqueous solvent was changed from Isopar H to Isopar G, n-octane or n-nonane, and the amount of the liquid on the aluminum substrate at the time of transferring was adjusted to 16 g/m². Transferring efficiency and transferred image quality were both good as in Example 1.

TABLE 3

| Non-Aqueous Solvent | Amount of Remaining Rinsing Solution on Photoreceptor (mg/mg-toner weight) | Amount of Remaining Liquid on Aluminum Substrate (g/m²) | Transferring Efficiency (%) | Transferred Image Properties |
|---|---|---|---|---|
| Isopar G | 1 | 16 | 100 | ○ |
| n-Octane | 1 | 16 | 100 | ○ |
| n-Nonane | 1 | 16 | 100 | ○ |

TABLE 4

| Example | Transferring Properties in Examples 3 to 6 | | | |
|---|---|---|---|---|
| | Amount of Remaining Liquid after Rinsing (mg/mg-toner weight) | Amount of Liquid on Aluminum Substrate (g/mg) | Transferring Efficiency (%) | Transferred Image Properties |
| Example 3 | 1 | 16 | 100 | ○ |
| Example 4 | 1 | 16 | 99 | ○ |
| Example 5 | 1 | 16 | 98 | ○ |
| Example 6 | 1 | 25 | 100 | ○ |

EXAMPLE 3

An image was transferred in the same manner as in Example 1 except that the amount of the non-aqueous solvent on the aluminum substrate at the time of transferring was controlled to 16 g/m² by employing hot air drying (40° C. for 5 minutes on the image-carrying member) in place of natural drying after rinsing. Transferring efficiency and transferred image quality are shown in Table 4. They were good as in Example 1.

EXAMPLE 4

In Example 1, transferring was carried out by applying a direct current of +200 V on the aluminum substrate between the electrophotographic photoreceptor and the aluminum substrate after adjusting the amount of the liquid on the aluminum substrate to 16 g/m² at the time of transferring in place of applying minus corona discharging from the side of the electrophotographic photoreceptor at the time of transferring. Transferring efficiency and transferred image quality are shown in Table 4. They were good as in Example 1.

EXAMPLE 5

An image was transferred in the same manner as in Example 4 except that the amount of the liquid was controlled on the surface of the image on the photoreceptor in place of controlling the amount of the liquid on the aluminum substrate. Transferring efficiency and transferred image quality are shown in Table 4. They were good as in Example 4.

EXAMPLE 6

In Example 5, in place of transferring onto an aluminum substrate, an aluminum substrate was used as a metal electrode, and paper was brought into close contact therewith to prepare a transferring material. An image was transferred in the same manner as in Example 5 except that the above transferring material was used and the amount of the liquid on the paper was adjusted to 25 g/m². Transferring efficiency and transferred image quality are shown in Table 4. They were good as in Example 5.

EXAMPLE 7 TO 10

An image was transferred in the same manner as in Example 1 except that the ethylene-methacrylic acid copolymer used as a coating agent for the pigment of the liquid developer was changed to another ethylene-based copolymer shown in Table 5. It exhibited good transferring properties as in Example 1.

TABLE 5

| Example | Type of Copolymer |
|---|---|
| Example 7 | Ethylene-Vinyl acetate copolymer (trade name: Evaflex 460, produced by Mitsui Dupont Chemical Co., Ltd.) |
| Example 8 | Ethylene-ethyl acrylate copolymer (trade name: DPDJ-6169, produced by Nippon Unicar Co., Ltd.) |
| Example 9 | Ethylene-n-dedecyl methacrylate copolymer (copolymerization ratio = 0.96:0.04 (molar ratio) |
| Example 10 | Ethylene-methacrylic acid-n-dodecyl methacrylate terpolymer (copolymerization ratio = 0.96:0.02:0.02 (molar ratio)) |

EXAMPLE 11

A developer was prepared in the same manner as in Example 1 except that the ethylene-methacrylic acid copolymer used as a coating agent for the pigment of the liquid developer was changed to an ethylene-vinyl acetate copolymer (trade name: Evaflex 460).

In the method of Example 1, after rinsing with Isopar H, the material was dried for one minute and, thereafter, an image was transferred in the state that there was no liquid on the aluminum substrate, to thereby obtain a transferred image (Comparative Example A).

On the other hand, after rinsing with Isopar H, the material was dried for 7 minutes and, thereafter, an image was transferred in the state that there was 25 g/m$^2$ of Isopar H on the aluminum substrate, to thereby obtain a transferred image (Present Invention B).

A transferred image having a line width of 70 microns was observed with a microscope. In Comparative Example A, the edge was not sharp, while in Present Invention B, the edge was sharp.

While the invention has been described in detail and with reference to specific embodiments thereof, it will be apparent to one skilled in the art that various changes and modifications can be made therein without departing from the spirit and scope thereof.

What is claimed is:

1. A method of transferring an image by a wet-type electrostatic photographic system which comprises developing an electrostatic latent image formed on an image-carrying member with an electrostatic photographic liquid developer containing at least toner particles and a carrier liquid, and transferring the toner image from the toner image-carrying member to a member to which the image is to be transferred, by one transferring step or a plurality of transferring steps, wherein the transferring step includes at least the following steps:

(1) a step to substantially dry the toner image;

(2) a step to supply a non-aqueous solvent having a volume resistance of at least $10^9$ Ω·cm and a dielectric constant of not more than 3 into a clearance between the toner image-carrying member and the member to which the image is to be transferred; and (3) a step to transfer the toner image to the member to which the image is to be transferred.

2. A method as claimed in claim 1, wherein the toner particle component of the liquid developer for electrostatic photography contains at least one ethylene-based copolymer.

3. A method as claimed in claim 1, wherein the toner image prior to step (2) comprises not more than 20 mg carrier liquid per mg of toner particles.

4. A method as claimed in claim 1, wherein the toner image prior to step (2) comprises not more than 10 mg carrier liquid per mg of toner particles.

5. A method as claimed in claim 1, wherein the toner image prior to step (2) comprises not more than 5 mg carrier liquid per mg of toner particles.

6. A method as claimed in claim 1, wherein the step of substantially drying the toner image is preceded by a step of rinsing the toner image with a non-aqueous solvent of at least $10^9$ Ω·cm and a dielectric constant of not more than 3.

7. A method as claimed in claim 6, wherein the toner image prior to step (2) comprises not more than 20 mg non-aqueous solvent per mg of toner particles.

8. A method as claimed in claim 6, wherein the toner image prior to step (2) comprises not more than 10 mg non-aqueous solvent per mg of toner particles.

9. A method as claimed in claim 6, wherein the toner image prior to step (2) comprises not more than 5 mg non-aqueous solvent per mg of toner particles.

10. A method as claimed in claim 1, the image-carrying member having the substantially dried toner image thereon is subjected to corona discharging to uniformly charge the image on the image carrying member prior to step (2).

11. A method as claimed in claim 1, wherein said step of substantially drying the toner image is carried out until almost no liquid can be visually observed on the surface of the toner image.

* * * * *